US005859622A

United States Patent [19]

Phillips

[11] Patent Number: 5,859,622

[45] Date of Patent: Jan. 12, 1999

[54] MECHANICALLY CONTROLLED VELOCITY EXTENDER SYSTEM FOR ANTENNAS

[75] Inventor: John Charles Phillips, Apex, N.C.

[73] Assignee: Ericsson, Inc., Research Triangle Park, N.C.

[21] Appl. No.: 922,234

[22] Filed: Sep. 2, 1997

Related U.S. Application Data

[63] Continuation of Ser. No. 641,959, May 1, 1996, abandoned.

[51] Int. Cl.[6] ..... H01Q 1/10

[52] U.S. Cl. ..... 343/903; 343/702

[58] Field of Search ..... 343/702, 900, 343/901, 903, 877; H01Q 1/10, 1/24

[56] References Cited

U.S. PATENT DOCUMENTS

| | | | |
|---|---|---|---|
| 2,522,222 | 9/1950 | Haller | 343/903 |
| 4,725,845 | 2/1988 | Phillips | 343/702 |
| 4,811,564 | 3/1989 | Palmer | 60/527 |
| 4,990,929 | 2/1991 | Nakase et al. | 343/903 |
| 5,168,278 | 12/1992 | Morita | 343/702 |

FOREIGN PATENT DOCUMENTS

| | | | |
|---|---|---|---|
| 6-177622 | 6/1994 | Japan | H01Q 1/10 |

OTHER PUBLICATIONS

Patent Abstracts of Japan, vol. 18, No. 509 (E–1610), 26 Sep. 1994 JP 06 177622A.

*Primary Examiner*—Michael C. Wimer
*Attorney, Agent, or Firm*—Jenkens & Gilchrist

[57] ABSTRACT

An antenna extender system includes a means for applying a bias force on the antenna to urge it toward an extended position, and a means for controlling the velocity of the antenna when it is moved from a retracted to the extended position by a constant bias force. The antenna extender system solves the problem of uncontrolled instantaneous extension of antennas in small, mobile telecommunication instruments.

2 Claims, 2 Drawing Sheets

MECHANICALLY CONTROLLED VELOCITY EXTENDER SYSTEM FOR ANTENNAS

This is a continuation of application Ser. No. 08/641,959, filed May 1, 1996 abandoned.

This invention relates generally to automatic extender systems for antennas, and more particularly to mechanically powered systems suitable for use in portable telecommunication equipment.

BACKGROUND OF THE INVENTION

Retractable antennas are commonly used in mobile telecommunication equipment such as portable telephones, cellular phones and two-way radios. Typically, retractable antennas used in mobile telecommunication instruments require two-handed operation for extension. For example, when answering a call on a cellular phone, the user must open the flip-open cover, if so equipped, pull out the antenna with one hand while holding the phone in the other hand, push a button to answer the call, then speak. This multiple step operation is cumbersome, particularly if the user is carrying another article or is otherwise impaired from using both hands to extend the antenna.

Several arrangements have been proposed for powering the extension of the antenna on small, mobile telecommunication instruments. Electrically powered, motor driven antenna extenders, such as those found on vehicles and larger communication instruments, are undesirable for small instruments because of the space requirements for the motor and drive mechanisms, the resultant added weight and cost, and the significant current draw on a limited power source, i.e., the batteries of the instrument.

Other arrangements have also been proposed for the automatic extension of antennas for mobile telecommunication instruments. For example, a guided helical compression spring arrangement is disclosed in co-pending application Ser. No. 08/627,448, filed Apr. 14, 1996 by Charles A. Rudisill for a RETRACTABLE ANTENNA ASSEMBLY, and assigned to the Assignee of the present invention. Other linear or variable rate springs, such as helical extension springs, have also been proposed for use in antenna extension systems. However, spring extension systems using either linear or variable rate springs apply a significantly higher bias force on an antenna when it is deflected than when it approaches its free length. For example, if an antenna is biased at the extended position with a minimal preload spring force, the force acting on the antenna when retracted will be the product of the spring rate times the deflection of the spring, plus the preload force. The resultant high bias force produced by such springs causes the antenna, when released, to extend very rapidly, virtually instantaneously. If the user is careless, the rapidly extending distal end of the antenna could strike an object or person, perhaps even in the eye, and cause serious damage or injury.

The present invention is directed to overcoming the problems set forth above. It is desirable to have an extension system for the antenna on mobile telecommunication instruments that is small, lightweight, economical to produce, and does not require an auxiliary power source for its operation. It is also desirable to have such an extension system that automatically extends the antenna at a predetermined controlled velocity, upon actuation of a release latch.

SUMMARY OF THE INVENTION

In accordance with one aspect of the present invention, an extension system for an antenna includes a body member that supports the antenna at an extended position and encloses the antenna at a retracted position, and a selectively releasable means for maintaining the antenna at the retracted position. The extension system also includes a means for applying a bias force on the antenna in a direction which urges the antenna toward the extended position, and a means for controlling the velocity of the antenna when the antenna moves from the retracted to the extended position.

Other features of the extension system for an antenna, embodying the present invention, include the means for applying a bias force on the antenna being a constant force spring having an extendable end attached to an end of the antenna. Another feature of the extension system embodying the present invention, includes the means for controlling the velocity of the antenna when the antenna moves from the retracted to the extended position being a rotary motion damper operatively attached to the constant force spring.

DETAILED DESCRIPTION

Figure 1:
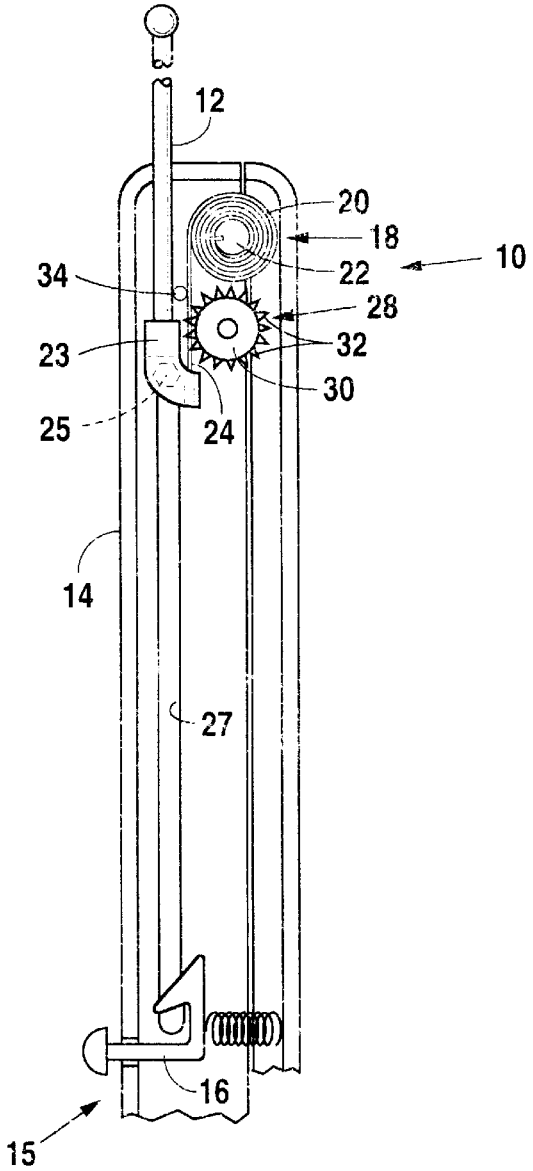
FIG. 1 is a cross-sectional view of the preferred embodiment of an extension system for an antenna, embodying the present invention, showing the antenna in an extended position.

In the preferred embodiment of the present invention, an extension system 10 for an antenna 12 that is movable between an extended position, as shown in FIG. 1, to a retracted position. includes a body member 14, such as the case or frame of a cellular or portable phone which supports the antenna 12 when in the extended position, and protectively encloses the antenna 12 when retracted. Desirably, the antenna 12 is maintained at the retracted position by an easily operable antenna release means 15 that is selectively operable, such as a spring loaded latch 16 described below in more detail.

The antenna extension system 10 embodying the present invention includes a means 18 for applying a bias force on the antenna 12 in a direction which always urges the antenna toward the extended position. When the antenna release means 15 is activated to release the antenna 12 from the retracted position, the means 18 for applying a bias force moves the antenna 12 from the retracted position to the extended position, and maintains the antenna 12 at the extended position until the antenna 12 is retracted by manually pushing the antenna 12 into the body member 14.

In the preferred embodiment of the present invention, the means 18 for applying a bias force comprises a constant force spring 20, such as a flat strip wound to form a coil which maintains essentially the same diameter as one end of the spring is unrolled from the coil. Constant force springs provide a bias force having a constant value regardless of deflected position or displacement. The constant force spring 20 has one end at the center of the coil that is rotatably attached to the body member 14, such as by a short spool 22, and an extendable end 24 that is attached to the lower, or proximal end of the antenna 12. Such springs are commercially available, in almost any length, width and force rating, such as the CONFORCE™ line of springs produced by Vulcan Spring & Mfg. Co., Telford, Pa. Alternatively, the means 18 for applying a bias force may comprise a variable rate spring having the same shape and form as the constant force spring 20, or other suitable construction.

In the preferred embodiment of the present invention, the spring 20 has a plurality of equidistantly spaced apart apertures 26 formed along a preselected portion of the length, either along only a central section or along the entire length, of the spring 20. In an illustrative embodiment, the spring 20 is a constant force spring having a constant force rating of about 0.11 lbs, a width of about 0.25 in, and length of about 6 in, which provides about 1½ turns of the coil form remaining when the antenna is fully extended.

Also, in the preferred embodiment of the present invention, the extendable end 24 of the spring 20 is attached to the lower, or proximal end of the antenna 12 by a connector 23. The connector 23, preferably formed of an electrically nonconductive plastic material, is fixedly attached to both the antenna 12 and the spring 20 and has a laterally extending guide pin 25 that slides along a guide groove 27 defined in the body 14. The guide pin 25 maintains the respective orientation and alignment of the antenna 12 and the extendable end 24 of the spring 20 during extension and retraction of the antenna 12 and the spring 20.

Importantly, the antenna extension system 10 embodying the present invention also includes a means 28 for controlling the velocity of the antenna 12 when it moves, under the force, or torque, provided by the spring 20, from the retracted to the extended position. In the preferred embodiment, the antenna velocity control means 28 comprises a rotary motion damper 30 having a plurality of sprocket teeth 32 equidistantly spaced apart, about the periphery of a viscously damped rotor, at a distance equal to that at which the apertures 26 are spaced along the spring 20.

Rotary motion dampers of the type described are typically used in the automotive industry to control the rate of opening or closing of such devices as cup holders, ashtrays, and glove boxes. Such rotary motion dampers are available from a number of commercial sources, including ITW Deltar/Shakeproof Division of Global Automotive & Specialty Components group, Glenview, Ill. Other motion dampers, such as linear motion dampers, may also be used to provide the means 28 for controlling the velocity of the antenna. However, linear motion dampers are generally less desirable because of their length and operational space requirements.

Preferably, the rotary motion damper 30 is mounted on the body member 14 at a position immediately below the spring 20 in alignment with the extended portion of the spring 20 so that the spring 20 contacts the rotor of the viscous damper 30, and the sprocket teeth 32 readily engage the apertures 26 formed in the spring 20. Desirably, an alignment guide such as a pin 34 extending outwardly from a side surface of the body member 14, is positioned in close proximity to the sprocket teeth 32 of the viscous damper 30 to assure continuous engagement of the sprocket teeth 32 in the apertures 26 during extension and retraction of the antenna 12 and the spring 20.

In the preferred embodiment, the rotary motion damper 30 is selected to provide a damping force of about 0.11 lbs at 250 rpm, a force sufficient to control, or limit, the extension velocity of the antenna 12 when driven by a constant force spring having a force rating of 0.11 lbs, to a desired rate of about 3 in/sec. This arrangement is especially advantageous because the damping force of viscous dampers is speed dependent, i.e., the faster the rotary motion of the rotor element of the damper, the greater the damping force. This characteristic is particularly important because it provides damping, or resistance to rapid extension, of the antenna 12 during extension by the spring 20, but does not significantly inhibit the relatively slower manual retraction of the antenna 12 after use.

Figure 3:
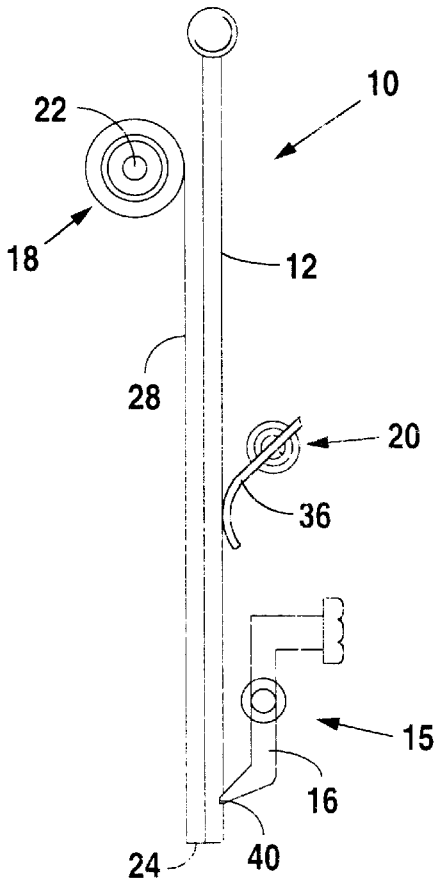
FIG. 3 is a schematic view of an alternative embodiment of an extension system for an antenna, embodying the present invention, showing the antenna at a retracted position; and, FIG. 4 is a schematic view of another alternative embodiment of an extension system for an antenna, embodying the present invention, showing the antenna at the retracted position.

Alternatively, the means 28 for controlling the velocity of the antenna 12 when the antenna 12 moves from the retracted to the extended position, includes a spring-loaded, pivotally-mounted friction member 36 that is biased, as illustrated in FIG. 3, to apply a friction resistance on the outer surface of the antenna 12. The frictional force produced by the biased friction member 36 on the antenna 12 increases as a function of the velocity of antenna 12 during extension, but is reduced during retraction because the downward motion of the antenna 12 tends to move the friction member 36 away from the antenna surface.

Figure 4:
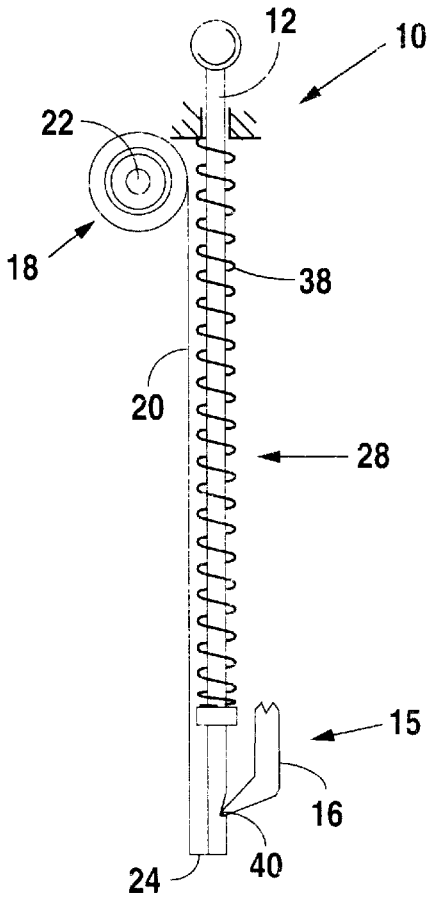

In another alternative arrangement, the means 28 for controlling the velocity of the antenna 12 when the antenna 12 moves from the retracted to the extended position, includes a helical compression spring 38 that is concentrically mounted around the antenna 12 as shown in FIG.4. In this arrangement, the helical compression spring 38 is desirably selected to have linear, or variable, deflection-dependent force rate value, such that when the helical compression spring 38 is fully compressed, i.e., the antenna 12 is fully extended, its total force is only slightly less than the value of the constant force spring 20. Thus, as the antenna extends, under the constant bias force supplied by the constant force spring 20, the resistance to such extension, provided by the compression spring 38, is initially very low but increases during extension of the antenna 12 at a linear, or variable, rate, thereby tending to slow the velocity of the antenna 12 as it approaches the extended position. As stated above, at the extended position the opposing spring forces should be nearly equal, with the bias force of the constant force spring 20 being slightly greater to assure provision a net force sufficient to maintain the antenna 12 at the extended position.

Alternatively, the means 18 for applying a bias force on the antenna 12 may comprise a variable rate spring. In this arrangement, the force rate of the helical compression spring 38 desirably has a value slightly less than that of the variable rate spring biasing the antenna 12, to assure that the net force acting on the antenna 12 is sufficient to maintain the antenna 12 at the extended position.

Figure 2:
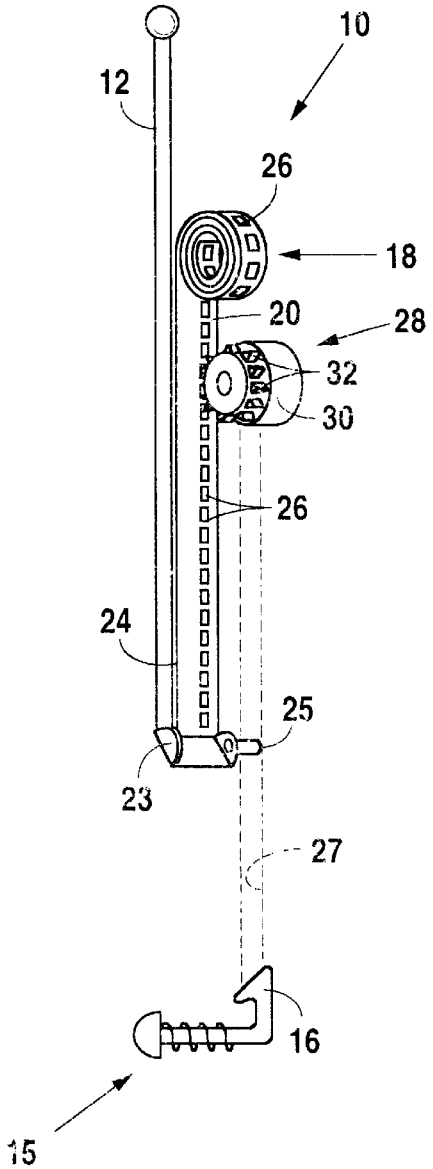
FIG. 2 is a three-dimensional view of the preferred embodiment of an extension system for an antenna, embodying the present invention, showing the antenna at an intermediate position.

The means 15 for selectively maintaining the antenna 12 at the retracted position is, as mentioned briefly above, desirably a spring loaded latch 16. In the preferred embodiment, the latch 16 has an end that is adapted to engage the guide pin 25 on the connector 23, as shown in FIGS. 1 and 2. Alternatively, as shown in FIGS. 3 and 4, the antenna 12 has a detent 40, or notch, formed on the outer surface, at a position near the proximal end of the antenna 12. In either arrangement, the latch 16 may be a spring-biased button or lever, as respectively illustrated in the drawings, or it may be mechanically interconnected with a flip cover or other movable element of a portable phone so that when the movable element is actuated, the latch 16 is automatically moved to its release position. When released, the spring 20 drives the antenna 12 to the extended position at a rate, or velocity, that is modulated by the means 28 for controlling the velocity of the antenna 12 when it moves from the retracted to the extended position.

Although the present invention is described in terms of a preferred exemplary embodiment, those skilled in the art will recognize that changes in the connection arrangement of the rotary motion damper 30 with the constant force spring 20 and the use of other antenna release latch arrangements may be made, consistent with the specifically stated functional requirements to mechanically provide a bias force to extend the antenna 12 and to control, or modulate, the velocity of the antenna 12 during extension, without departing from the spirit of the invention. Such changes are intended to fall within the scope of the following claims. Other aspects, features and advantages of the present invention can be obtained from a study of this disclosure and drawings, along with the appended claims.

What is claimed is:

1. An extension system, comprising:

an antenna that is selectively movable between an extended position and a retracted position;

a body member adapted to support the antenna at said extended position and protectively enclose the antenna at said retracted position;

a means for maintaining the antenna at said retracted position;

a constant force spring having one end rotatably connected to said body member and an extendable end attached to a proximal end of said antenna, wherein said constant force spring has a predetermined length and a plurality of equidistantly spaced apart apertures formed in said spring along a preselected portion of said length and, a rotary motion damper having a plurality of sprocket teeth defined thereon adapted to engage the apertures formed in said spring.

2. An extension system, comprising:

an antenna that is selectively moveable between an extended position and a retracted position;

a body member adapted to support the antenna at said extended position and protectively enclose the antenna at said retracted position;

a means for maintaining the antenna at said retracted position;

a variable rate spring having one end rotatably connected to said body member and an extendable end attached to a proximal end of said antenna, said variable rate spring having a predetermined length with a plurality of equidistantly spaced apertures formed in said variable rate spring along a selected portion of said length; and;

a rotary motion damper having a plurality of sprocket teeth defined thereon adapted to engage the apertures formed in said variable rate spring.

* * * * *